US010070735B2

(12) United States Patent
Patel et al.

(10) Patent No.: US 10,070,735 B2
(45) Date of Patent: Sep. 11, 2018

(54) FURNITURE WITH METALLIC INSERTS FOR STORING BENEFICIAL OBJECTS

(71) Applicant: DREAMZEN, INC., Las Vegas, NV (US)

(72) Inventors: Dilip Kumar Patel, Irvine, CA (US); Mangesh Mahajan, Irvine, CA (US)

( * ) Notice: Subject to any disclaimer, the term of this patent is extended or adjusted under 35 U.S.C. 154(b) by 0 days.

(21) Appl. No.: 15/031,215

(22) PCT Filed: Apr. 20, 2016

(86) PCT No.: PCT/US2016/028341
§ 371 (c)(1),
(2) Date: Apr. 21, 2016

(87) PCT Pub. No.: WO2017/184128
PCT Pub. Date: Oct. 26, 2017

(65) Prior Publication Data
US 2018/0078047 A1 Mar. 22, 2018

(51) Int. Cl.

| | |
|---|---|
| ***A47C 31/00*** | (2006.01) |
| ***A47C 7/62*** | (2006.01) |
| ***A47G 33/00*** | (2006.01) |
| ***A47C 17/86*** | (2006.01) |
| ***E05G 1/10*** | (2006.01) |

(52) U.S. Cl.
CPC ..... *A47C 31/004* (2013.01); *A47C 7/62* (2013.01); *A47C 17/86* (2013.01); *A47G 33/00* (2013.01); *E05G 1/10* (2013.01)

(58) Field of Classification Search
CPC ..... A47C 31/00
USPC ..... 5/639–694, 906
See application file for complete search history.

(56) References Cited

U.S. PATENT DOCUMENTS

| | | | |
|---|---|---|---|
| 2,895,145 | A | 7/1959 | Soifer |
| 4,807,315 | A | 2/1989 | Wachenheim |
| 5,593,059 | A | 1/1997 | Neilson |
| 6,292,960 | B1 | 9/2001 | Bowling |
| 6,683,779 | B2 | 1/2004 | Ober |
| 7,917,977 | B1 | 4/2011 | Remis |

FOREIGN PATENT DOCUMENTS

| | | | |
|---|---|---|---|
| AU | 629487 | B2 | 7/1992 |
| CN | 2840972 | Y | 11/2006 |
| CN | 2860518 | Y | 1/2007 |
| CN | 202959627 | U | 6/2013 |
| CN | 203897830 | U | 10/2014 |
| CN | 104720417 | A | 6/2015 |
| KR | 2019990022158 | U | 6/1999 |
| KR | 200322145 | Y1 | 7/2003 |
| KR | 100549196 | B1 | 2/2006 |
| KR | 1020070029945 | A | 3/2007 |
| KR | 200438116 | Y1 | 1/2008 |
| KR | 101175995 | B1 | 8/2012 |

*Primary Examiner* — Fredrick C Conley
(74) *Attorney, Agent, or Firm* — Joseph P. Kincart; Rogers Towers, P.A.

(57) ABSTRACT

Disclosed is a furniture for facilitating well-being of a user of the furniture. The furniture may include one or more metallic inserts configured to be inserted within a part of the furniture. Additionally, the one or more metallic inserts may be removable. Further, the one or more metallic inserts may include a hollow structure configured to accommodate one or more beneficial objects such as, one or more of a therapeutic substance, a religiously significant substance and a spiritually significant substance.

6 Claims, 10 Drawing Sheets

FURNITURE WITH METALLIC INSERTS FOR STORING BENEFICIAL OBJECTS

FIELD

The present disclosure generally relates to furniture. More specifically, the present disclosure relates to furniture with metallic inserts configured for storing one or more beneficial objects, such as, but not limited, a therapeutic substance, a religiously significant substance and a spiritually significant substance.

BACKGROUND

People spend a large amount of their lives using furniture of one kind or another. For instance, one third of a normal person's life is spent on a bed and/or a mattress. Further, a large part of waking life is spent being seated on a chair or a couch.

Accordingly, several advancements have been made in making furniture comfortable and pleasurable to use. For instance, many innovations have been made with regard to material and structural configuration of the furniture to make them durable and comfortable. Such innovations largely have focused on improving the physical, chemical and aesthetic aspects of the furniture.

Additionally, innovations with regard to improving utilitarian aspects of furniture have also been widely put forth. For example, modularity is a feature that allows the furniture to be transported, assembled and/or disassembled conveniently. As another example, furniture designers have introduced a secondary functionality in furniture which are generally meant to serve another primary functionality. For instance, couches which are generally meant for seating may be provided with storage functionality to store objects such as books that may be readily accessible to a person seated on the couch.

However, one may realize that improvements in furniture thus far have largely aimed to enhance experience of users with regard to aspects such as physical comfort, ergonomics, aesthetics and utility.

Further, furniture made of certain types of material may be prone to accumulate static electric charges due to usage. For instance, a mattress may accumulate substantial amount of static charges due to friction between the surface of the mattress and that of a person laying on the mattress.

Such accumulation of electric charges on furniture may lead to undesirable consequences. For instance, as a result of charges, the furniture may tend to attract dust particles from the surroundings. As another instance, the electric charges on the furniture may have unpleasant effects on persons using the furniture that may range from mild shocks to disturbance in harmony of bio-electric fields of persons.

SUMMARY

Disclosed is a furniture for facilitating well-being of a user of the furniture. According to some embodiments, the furniture may include one or more of a mattress and a mattress base. Further, in some other embodiments, the furniture may include one of a couch and a chair.

Further, the furniture may include one or more metallic inserts configured to be inserted within a part of the furniture. Further, one or more metallic inserts may be removable. In some embodiments, the part of the furniture configured to receive the one or more metallic inserts may include a base of the furniture.

Additionally, the one or more metallic inserts may include a hollow structure configured to accommodate one or more beneficial objects. In some embodiments, the one or more beneficial objects may include one or more of a therapeutic substance, a religiously significant substance and a spiritually significant substance. For instance, in some embodiments, the therapeutic substance may include one or more of a gauss stone, a germanium stone, a tourmaline stone and a jade stone.

In another instance, the one or more beneficial objects may include one or more of soil, rubble and ash. In yet another instance, the one or more beneficial objects may include one or more of a crystal and a mineral.

In some embodiments, the one or more beneficial objects may be previously experienced by the user for at least one of a predetermined number of instances and a predetermined period of time.

Furthermore, in some embodiments, the furniture may further include one or more secondary inserts. Accordingly, the one or more metallic inserts may be configured to accommodate the one or more secondary inserts. Additionally, the one or more secondary inserts may be configured to accommodate the one or more beneficial objects.

In some embodiments, the one or more metallic inserts may be configured to neutralize charges generated on a surface of the furniture. Accordingly, in some embodiments, the furniture may include a ground connector. A first end of the ground connector may be configured to be electrically connected, or otherwise in electrical communication with, the one or more metallic inserts thereby providing a ground to discharge any static charge that may form on the metallic insert. Further, a second end of the ground connector may be configured to be electrically connected to a ground terminal of a power outlet, thereby providing a ground to discharge any static charge that may form on the metallic insert.

In some embodiments, the one or more metallic inserts may include a plurality of metallic inserts arranged in a predetermined spatial configuration. Further, in some embodiments, the plurality of metallic inserts may include a first set of metallic inserts and a second set of metallic inserts. Additionally, each of the first set of metallic inserts may be oriented perpendicular to each of the second set of metallic inserts. Furthermore, the first set of metallic inserts may be oriented along a North-South direction while the second set of metallic inserts may be oriented along an East-West direction. Additionally, in some embodiments, the plurality of metallic inserts may be arranged in a plurality of layers. Each layer may include a plurality of metallic inserts configured to lie in a plane.

In some embodiments, a first metallic insert of the plurality of metallic inserts may be electrically connected to a second metallic insert of the plurality of metallic inserts. Additionally, in some embodiments, the furniture may further include electrical conductors configured to connect the first metallic insert and the second metallic insert. Further, in some embodiments, the furniture may further include conductive fibres configured to connect the first metallic insert and the second metallic insert.

In some embodiments, the furniture may further include a plurality of springs configured to provide each of cushioning and electrical connection between the first metallic insert and the second electrical insert.

In some embodiments, the furniture may further include a mechanical coupling configured to mechanically couple the plurality of metallic inserts. Further, the mechanical coupling may be configured to transition the plurality of metallic inserts from a first spatial configuration to a second spatial configuration.

DETAILED DESCRIPTION

Figure 1:
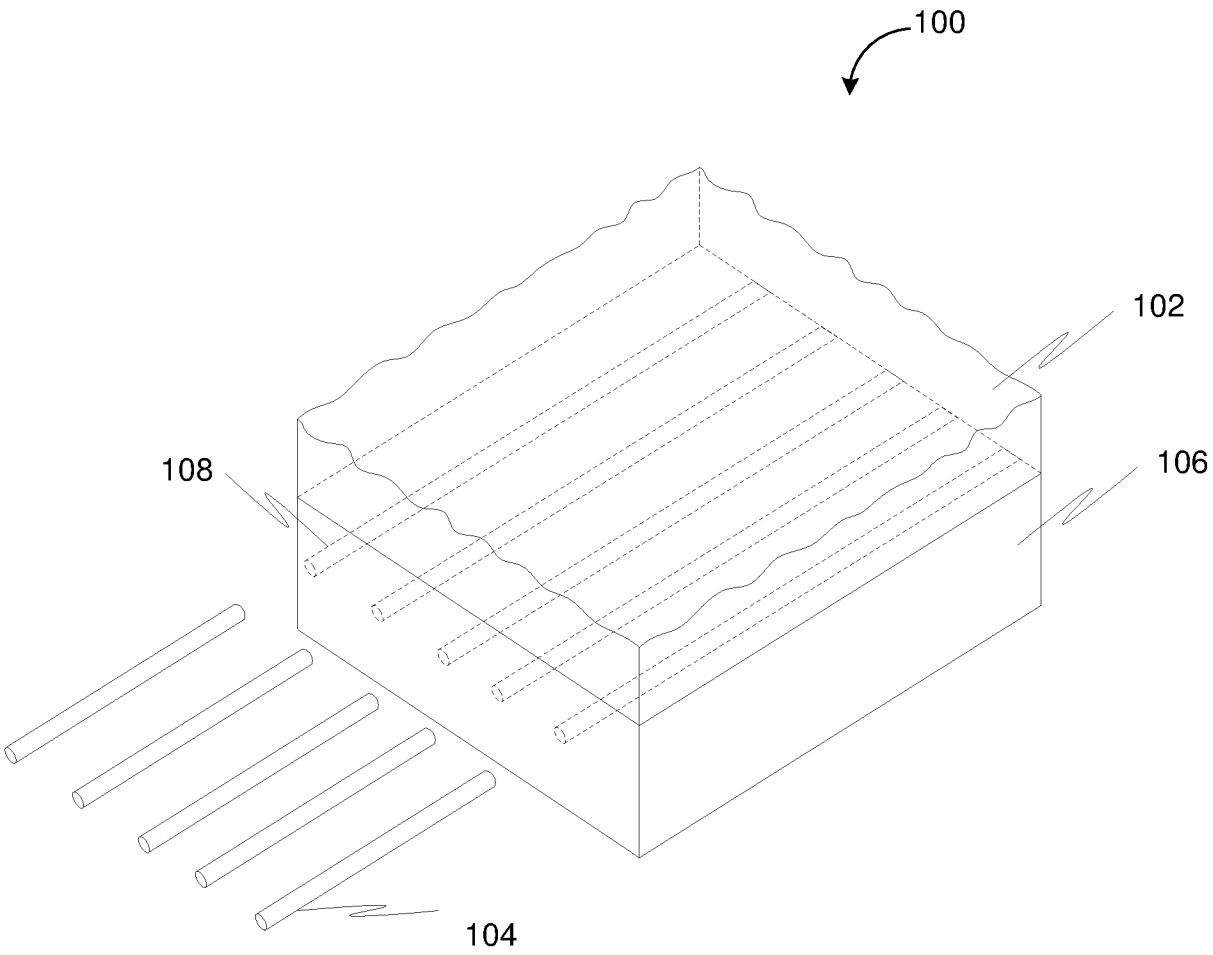
FIG. 1 illustrates a perspective view of a furniture, such as a bed with a mattress, including one or more metallic inserts in accordance with some embodiments.

FIG. 1 illustrates a perspective view of an article of furniture, such as a bed 100 with a mattress 102. The article of furniture including one or more metallic inserts 104 in accordance with some embodiments of the present invention.

As illustrated, the bed 100 may include a base 106, also commonly known as a foundation. Generally, the base 106 is a portion of the bed 100 placed on the ground or floor. Further, the base 106 may be designed to support the mattress 102 along with the weight of one or more persons on the mattress 102. Accordingly, the base 106 may be made of a durable material such as, for example, one or more of natural wood, plywood, synthetic wood, polymers, glass, metals and alloys.

Further, a structural configuration of the base 106 may assume various forms in different embodiments. Generally, the structural configuration of the base 106 may confirm to a form of the mattress 102. For instance, as shown in FIG. 1, the mattress 102 may be rectangular in shape. Accordingly, the base 106 may also be rectangular in shape, at least in part, in order to completely support the mattress 102.

Additionally, in some embodiments, the base 106 may be structurally configured in order to accommodate the one or more metallic inserts 104. Accordingly, the base 106 may include one or more cavities 108 configured to accommodate the one or more metallic inserts 104.

Further, in some embodiments, a shape of the one or more cavities 108 may be in spatial conformance with an external shape and/or dimensions of the one or more metallic inserts 104. For instance, as illustrated, the one or more metallic inserts 104 may be in the form of tubes. Accordingly, the shape of the one or more cavities 108 may be tubular with a diameter sufficient to receive and accommodate the one or more metallic inserts 104.

Figure 8:
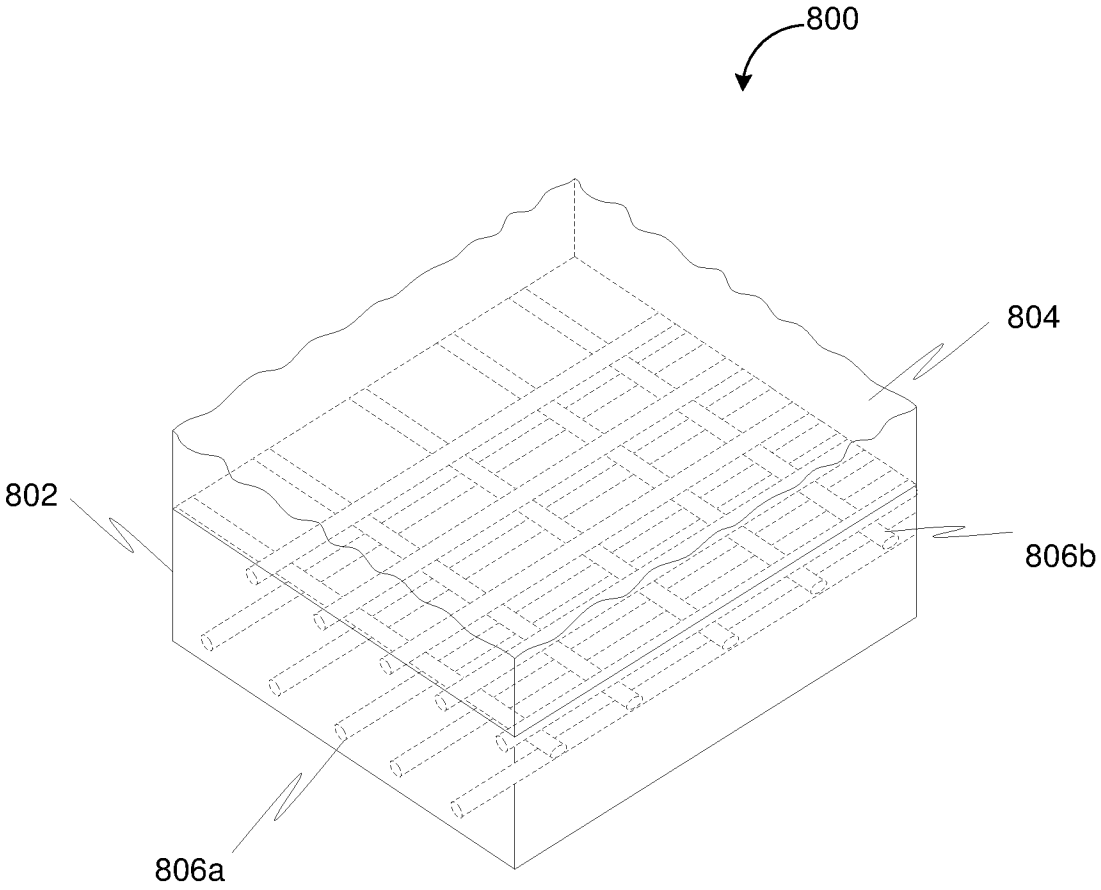
FIG. 8 illustrates a perspective view of a furniture, such as a bed with a mattress, including a plurality of metallic inserts arranged in a plurality of layers in accordance with some embodiments.

Furthermore, in some embodiments, the one or more cavities 108 may be in the form of one or more layers. Additionally, a layer of the one or more layers may be in any orientation with respect to a side of the bed 100 and/or the mattress 102. For example, the one or more cavities 108 may include multiple tubular hollow spaces arranged in a layer parallel with an upper side of the base 106 and/or the mattress 102 as illustrated in FIG. 1. Further, the multiple tubular hollow spaces may be arranged to be equidistant and parallel to each other. Similarly, in some other embodiments, the one or more cavities 108 may include multiple hollow spaces arranged in the form of a plurality of layers arranged parallel to each other and to the upper side of the base 106 and/or the mattress 102 as illustrated in FIG. 8.

In general, the one or more cavities 108 may be situated in one or more parts of the bed 100. For instance, in some embodiments, as illustrated, the one or more cavities 108 may be present in the base 106. However, in some other embodiments, the one or more cavities 108 may be present in the mattress 102 and/or the base 106.

Further, in some embodiments, at least one portion of the one or more cavities 108 may be accessible from outside the bed 100. For instance, as illustrated, the one or more cavities in the base 106 may be configured such that an end portion of each cavity of the one or more cavities 108 may be accessible at one or more sides of the base 106. In other words, one or more sides of the base 106 may include an opening leading into the one or more cavities 108. Accordingly, a user may be provided with convenient access to perform insertion and/or removal of the one or more metallic inserts 104 with respect to the one or more cavities 108.

Further, in some embodiments, an inner profile of the one or more cavities 108 may be configured in accordance with an outer profile of the one or more metallic inserts 104. For instance, as illustrated, a cross section of a metallic insert of the one or more metallic inserts 104 may be circular in shape. Accordingly, the inner profile of a corresponding cavity of the one or more cavities 108 may also be circular in shape in order to snugly accommodate the metallic insert. Consequently, when the one or more metallic inserts 104 are placed within the one or more cavities 108, there may be little or no gap between the outer walls of the one or more metallic inserts 104 and the inner walls of the one or more cavities 108. Accordingly, there may be very little or no play of the one or more metallic inserts 104 that may produce noise or increase wear.

Furthermore, in some embodiments, the one or more cavities 108 may be configured to allow movement of the one or more metallic inserts 104 within the one or more cavities 108. The movement may be according to one or more degrees of freedom depending on a configuration of each of the one or more metallic inserts 104 and the one or more cavities 108. For instance, as illustrated, the one or more cavities 108 in the form of tubular hollow structures may be configured to allow a metallic insert 104 in the form of a tube to move in a longitudinal direction within the one or more cavities 108. Further, the one or more metallic inserts 104 may also be axially rotatable within the one or more cavities 108.

Additionally, in some embodiments, an inner surface of the one or more cavities 108 may be configured to allow for movement of the one or more metallic inserts 104 within the one or more cavities 108 with substantially less friction. For instance, the inner surface of the one or more cavities 108 may be coated with a friction reducing coating, such as, for example, Teflon.

Moreover, in some embodiments, the inner surface of the one or more cavities 108 may be coated at least partially with an electrically conductive layer. Accordingly, an electrical path starting at and/or terminating on the one or more metallic inserts 104 may be created. For example, the bed 100 may include electrical connectors (not shown in figure) configured to electrically connect two or more cavities 108. Accordingly, when corresponding two or more metallic inserts 104 are placed within the two or more cavities 108, the electrical connectors may provide an electrical path between the two or more metallic inserts 104. As a result, the one or more metallic inserts 104 may collectively facilitate collection of electric charges.

Further, in some embodiments, an electrical path may be established between the one or more metallic inserts 104 and a portion of the mattress 102. Consequently, static electric charges accumulated on the mattress 102 may be neutralized by allowing flow of charges to and/or from the one or more metallic inserts 104. Furthermore, the one or more metallic inserts 104 may be electrically connected to a ground point, such as for example, a grounding terminal of a power outlet, in order to facilitate neutralization of charges.

Additionally, in some embodiments, the one or more cavities 108 may be configured to be movable in relation to the bed 100. For instance, the one or more cavities 108 may be provided by way of one or more tubular structures disposed within a guide-way such as, for example, a rectangular slot in the base 106. Further, the one or more tubular structures may be configured to move in a lateral direction within the rectangular slot. Accordingly, a user may position the one or more cavities 108 at a location as per the user's preference. For instance, the user may wish to position a relatively larger number of cavities 108 under a portion of the mattress 102 where the user is most likely to be laying.

More generally, in some embodiments, depending on a type and degree of movement of the one or more cavities 108 desired, one or more guide-ways of corresponding shape and/or dimensions may be provided within the base 106 and/or the mattress 102. Accordingly, one or more hollow structures providing the one or more cavities 108 may be moved along the one or more guide-ways and be positioned at locations preferred by a user.

Further, in some embodiments, the furniture may further include a mechanical coupling (not shown in figure) configured to mechanically couple a plurality of metallic inserts 104. Further, the mechanical coupling may be configured to transition the plurality of metallic 104 inserts from a first spatial configuration to a second spatial configuration. For example, a lever may be provided to enable a user to transition the plurality of metallic inserts 104 within a corresponding guide-way from a first orientation to a second orientation.

Further, in some embodiments, the one or more metallic inserts 104 may include one or more hollow spaces configured to store one or more beneficial objects. In generally, the one or more beneficial objects may be any substance whose presence within the furniture, such as bed 100, may provide at least one benefit to a person using the furniture. In some instances, the benefit may be due to physical proximity of the person to the one or more beneficial objects while using the furniture.

In some embodiments, the one or more beneficial objects may include one or more of a therapeutic substance, a religiously significant substance and a spiritually significant substance.

For instance, in some embodiments, the therapeutic substance may include one or more of a gauss stone, a germanium stone, a tourmaline stone and a jade stone. In another instance, the one or more beneficial objects may include one or more of soil, rubble and ash. In yet another instance, the one or more beneficial objects may include one or more of a crystal and a mineral.

In some embodiments, the one or more beneficial objects may be previously experienced by the user for at least one of a predetermined number of instances and a predetermined period of time. For example, a person may have spent a significant number of nights sleeping in the same environment, such as the person's home. As a result, the person may have developed a certain degree of conscious and/or subconscious familiarity with one or more physical objects constituting the environment. For instance, the soil in the ground surrounding the person's home may have unique physical and/or chemical characteristics. Accordingly, by maintaining presence of the one or more physical objects, such as the soil, within close proximity of the person when sleeping in a different place, such as a hotel room, the familiar feeling of the person's home may be recreated at least partially. Thus, the hotel room including the article of furniture, such as the bed 100 with the one or more metallic inserts 104 containing the one or more beneficial objects may at least partially facilitate recreation of a familiar experience to the person. Accordingly, one or more of a physical state, a physiological state, a psychological state and a spiritual state of the person may be entrained and/or enhanced.

The one or more metallic inserts 104 may include a size and shape and location within the article of furniture such that a person cognizant of the placement of the beneficial object within the metallic insert 104 may receive a benefit from the placement of the beneficial object within the metallic insert, while the person is in proximity to the metallic insert, such as for example while the person sits on a couch including the metallic insert.

Figure 2:
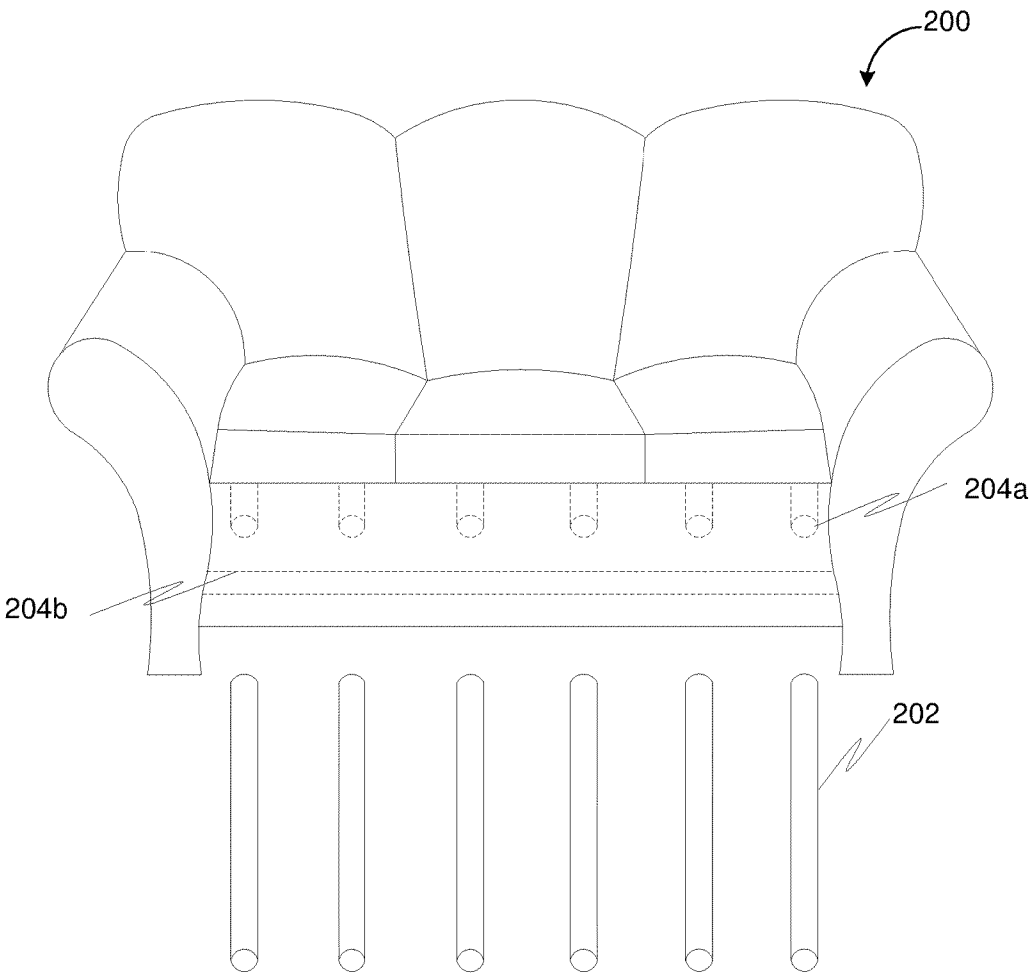
FIG. 2 illustrates a perspective view of a furniture, such as a couch, including one or more metallic inserts in accordance with some embodiments.

Turning to FIG. 2, a perspective view of a furniture, such as a couch 200, including the one or more metallic inserts 202 in accordance with some embodiments is illustrated. The one more metallic inserts 202 may be an instance of the one or more metallic inserts 104 described in detail in conjunction with FIG. 1. Accordingly, the couch 200 may include one or more cavities 204 configured to receive and/or accommodate the one or more metallic inserts 202. Further, the one or more cavities 204 may be an instance of the one or more cavities 108 described in detail in conjunction with FIG. 1. As shown, the one or more cavities 204 may include a plurality of lateral cavities 204*a* that may be oriented along a shorter dimension of the couch 200. Similarly, the one or more cavities 204 may include a plurality of longitudinal cavities 204*b* that may be oriented along a longer dimension of the couch 200.

Further, as shown, each of the plurality of laterally oriented cavities 204*a* may include a plurality of openings that may be located along a front side of the couch 200. Accordingly, convenient access may be provided to a user to perform one or more of insertion and removal of the one or more metallic inserts 202 with respect to the one or more laterally oriented cavities 204*a*.

Additionally, in some embodiments, the couch 200 may include cushions in order to provide comfortable seating to a user. Further, the cushions may be include elastic fibres. In some instances, the cushions may be disposed both inside and outside of the couch 200. Accordingly, in some instances, the one or more metallic inserts 202 may be surrounded by the elastic fibres. Furthermore, in some embodiments, the elastic fibres may be electrical conductive. Alternatively, the elastic fibres may be interspersed with an electrically conductive fibre, such as silver fibres or carbon nano-fibres. As a result, the one or more metallic inserts 202 may be electrically connected to each other.

Further, in some embodiments, an electrical path may be formed starting from the external surfaces of the couch 200 and terminating at the one or more metallic inserts 202. The electric path may be formed at least in part due to the electrically conductive fibres. Additionally and/or alternatively, in some embodiments, metallic springs may be used in the couch 200 in order to provide cushioning. Accordingly, the electrical path may be formed at least in part due to the metallic springs. Further, the electrical path may facilitate neutralization of static electric charges that may be accumulated on the couch 200 as a result of usage. Furthermore, the one or more metallic inserts 202 may be connected to a ground connecter (not shown in figure) leading to a ground terminal of a power outlet in order to facilitate neutralization of static electric charges on the couch 200.

Additionally, in some embodiments, the one or more metallic inserts 202 may include a hollow structure in order to receive and store one or more beneficial objects as explained in detail in conjunction with FIG. 1. Accordingly, well-being of a user of the couch 200 may be improved due being in physical proximity of the one or more beneficial objects while using the couch 200.

Figure 3:
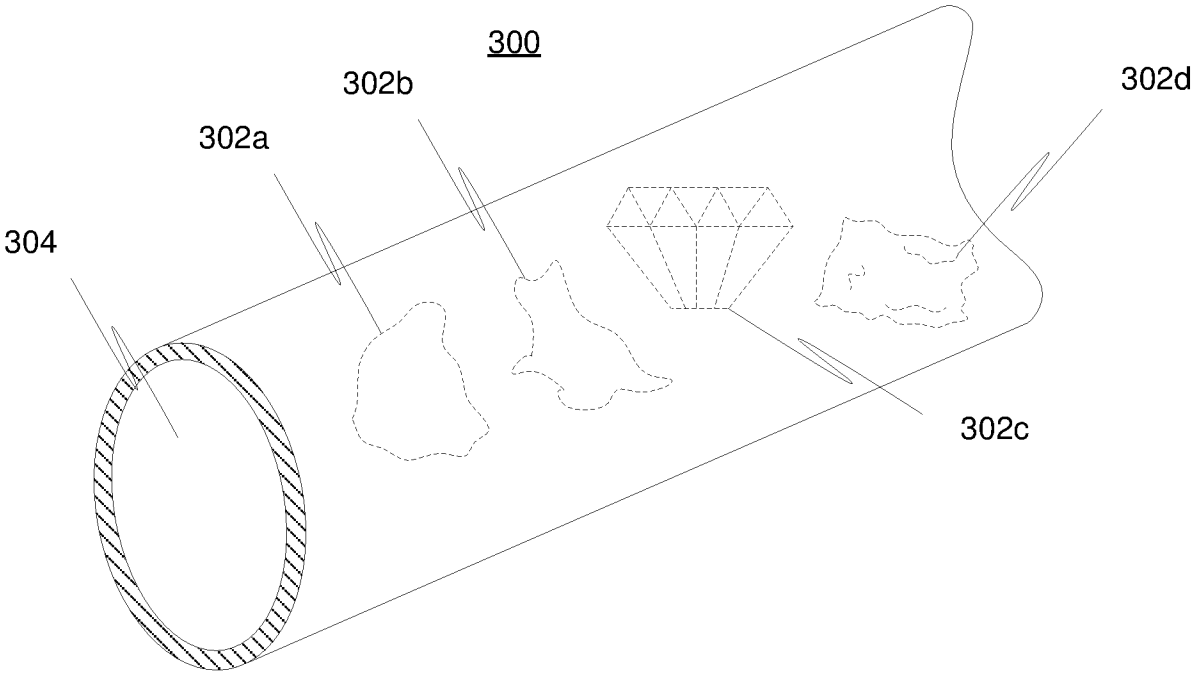
FIG. 3 illustrates a perspective view of a metallic insert configured for storing one or more beneficial objects such as, but not limited to, a therapeutic substance, a religiously significant substance and a spiritually significant substance.

FIG. 3 illustrates a perspective view of a metallic insert 300 configured for storing one or more beneficial objects 302 such as, but not limited to, a therapeutic substance, a religiously significant substance and a spiritually significant substance. The metallic insert 300 may be an instance of the one or more metallic inserts 104 and/or the one or more metallic inserts 202. An amount and/or quantity of beneficial object(s) 302 is preferably sufficient for a user to determine a benefit from the placement of the beneficial object in the article of furniture. For example a therapeutic substance may include an amount and proximity sufficient to be therapeutic of a user during a normal course or interacting with the article of furniture.

As illustrated, the metallic insert 300 may be of a tubular form with a cylindrical hollow space configured to receive and accommodate the one or more beneficial objects 302, such as 302*a*-302*d*. Further, the metallic insert 300 may include one or more openings, such as for example, opening 304 in order to receive and/or to remove the one or more beneficial objects. For example, the metallic insert 300 may be provided with openings at each end in order to facilitate a user to insert and/or remove the one or more beneficial objects. Furthermore, a dimension, such as diameter, of the metallic insert 300 may be configured to accommodate the one or more beneficial objects 302. Accordingly, in various embodiments, the metallic insert 300 may assume a multitude of shapes and sizes based upon a size and shape of an associated article of furniture and a size and shape of a beneficial object.

Additionally, in some embodiments, one or more pouches may be used in order to house the one or more beneficial objects 302. The one or more pouches may provide protection to the one or more beneficial objects 302 from friction against the inner walls of the metallic insert 300. Alternatively and/or additionally, in some embodiments, one or more fillers, such as for example, metallic and/or non-metallic fibres may be used to provide protection for the one or more beneficial objects 302. Further, in some embodiments, the metallic insert 300 may include an inner lining of a soft material to protect the one or more beneficial objects from friction against a metallic surface of the metallic insert 300.

Further, in some embodiments, the metallic insert 300 may include perforations on the wall. As a result, passage of air into and out of the hollow space may be facilitated. Accordingly, in some embodiments, efficacy of the one or more beneficial objects 302 may be enhanced.

Additionally, in some embodiments, an end-cap (not shown in figure) may be provided in order to cover an opening of the metallic insert 300. Further, the end-cap may be configured to be fastened to the opening of the metallic insert by a fastening means, such as, but not limited to, a rivet and/or a screw. Additionally, in some embodiments, the fastening means may be such that a user may be enabled to fasten and/or unfasten the end-cap without necessarily using a tool. Further, the end-cap may be constructed of a material similar to that of the metallic insert 300, such as, for example, copper. However, in some other embodiments, the material of the end-cap may be different from that of the metallic insert 300.

Further, in some embodiments, the metallic insert 300 may be covered by a soft material such as, for example, certified organic cotton calico. Accordingly, the use of the soft material may minimize and/or eliminate sounds resulting from movement of the metallic insert 300, if any, within the one or more cavities.

Figure 4:
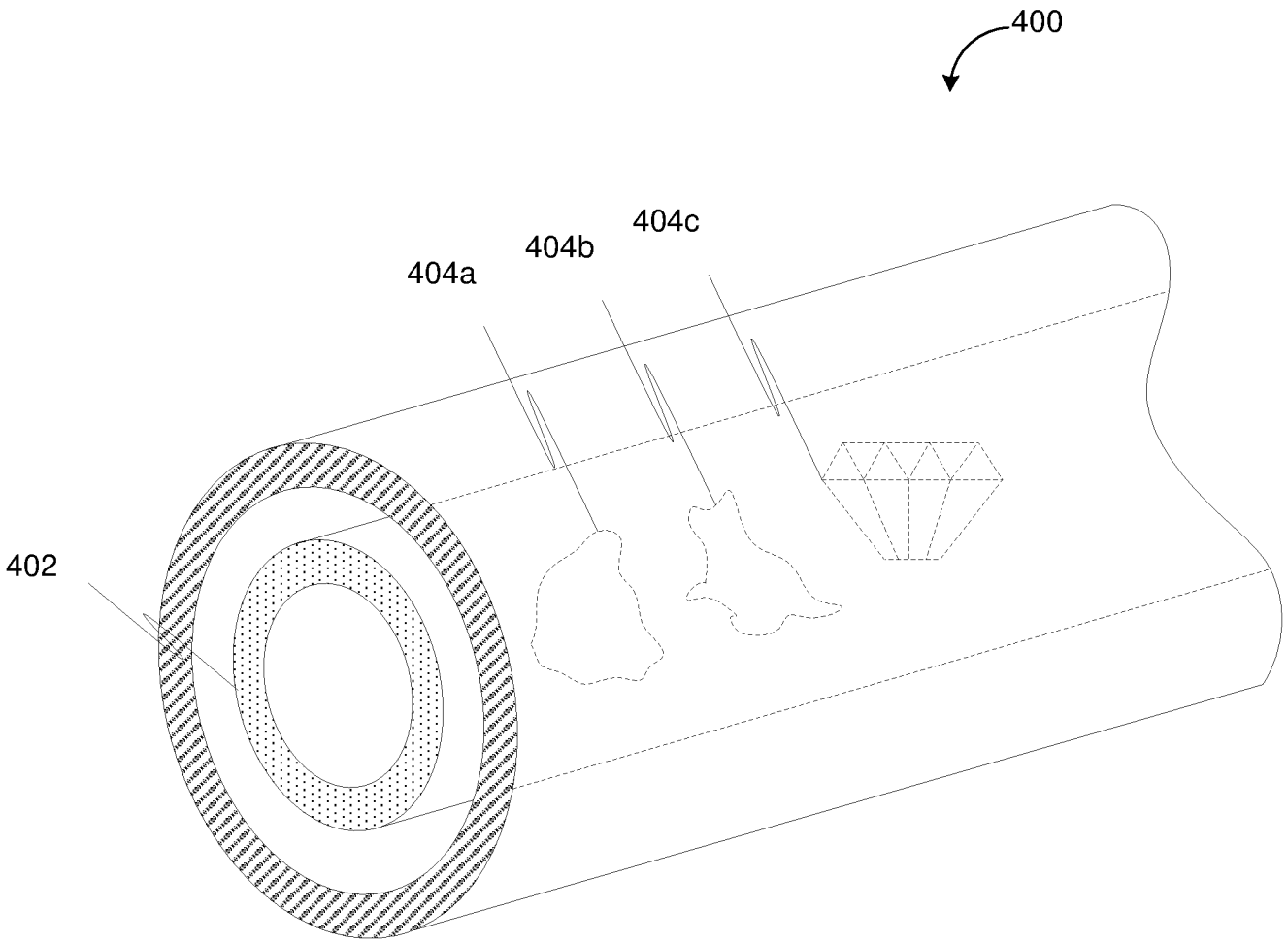
FIG. 4 illustrates a perspective view of a metallic insert configured for receiving a secondary insert configured for storing one or more beneficial objects such as, but not limited to, a therapeutic substance, a religiously significant substance and a spiritually significant substance.

Turning now to FIG. 4, a perspective view of the metallic insert 400 configured for receiving a secondary insert 402 configured for storing one or more beneficial objects 404 such as, but not limited to, a therapeutic substance, a religiously significant substance and a spiritually significant substance is illustrated. The metallic insert 400 may be an instance of one or more of metallic insert 104, 202 and 300. Accordingly, further details regarding the metallic insert 400 may be obtained from description of FIG. 1 to FIG. 3.

In some embodiments, the secondary insert 402 may provide a functionality that may be supplementary and/or complementary to that provided by the metallic insert 400. For instance, the secondary insert 402 may, in some embodiments, be made of a metallic substance. Further, the secondary insert 402 may be in electrical contact with the metallic insert 400. As a result, the secondary insert 402 may further facilitate neutralization of static electric charges that may be accumulated on the furniture. As another instance, the secondary insert 402 may, in some embodiments, be made of a non-metallic substance, such as plastic, configured to provide physical protection of the one or more beneficial objects 404, such as 404*a*-404*c* stored inside the hollow space of the secondary insert 402.

Further, in some embodiments, the secondary insert 402 may be configured to be accommodated within the metallic insert 400 with minimum or no play. In other words, the secondary insert 402 may be snuggly fit within the hollow structure of the metallic insert 400.

Additionally, in some embodiments, the secondary insert 402 may be configured such that the secondary inset 402 may be rotatable around a longitudinal axis with respect to the metallic insert 400.

Furthermore, in some embodiments, an intermediate layer (not shown in figure) may be included between the outer surface of the secondary insert 402 and the inner surface of the metallic insert 400. The intermediate layer may be configured to provide cushioning and/or protection against friction induced wear.

Additionally, in some embodiments, the secondary insert 402 may include perforations. As a result, passage of air into and out of the hollow space of the secondary insert 402 may be facilitated. Accordingly, in some embodiments, efficacy of the one or more beneficial objects 404 may be enhanced.

Figure 5:
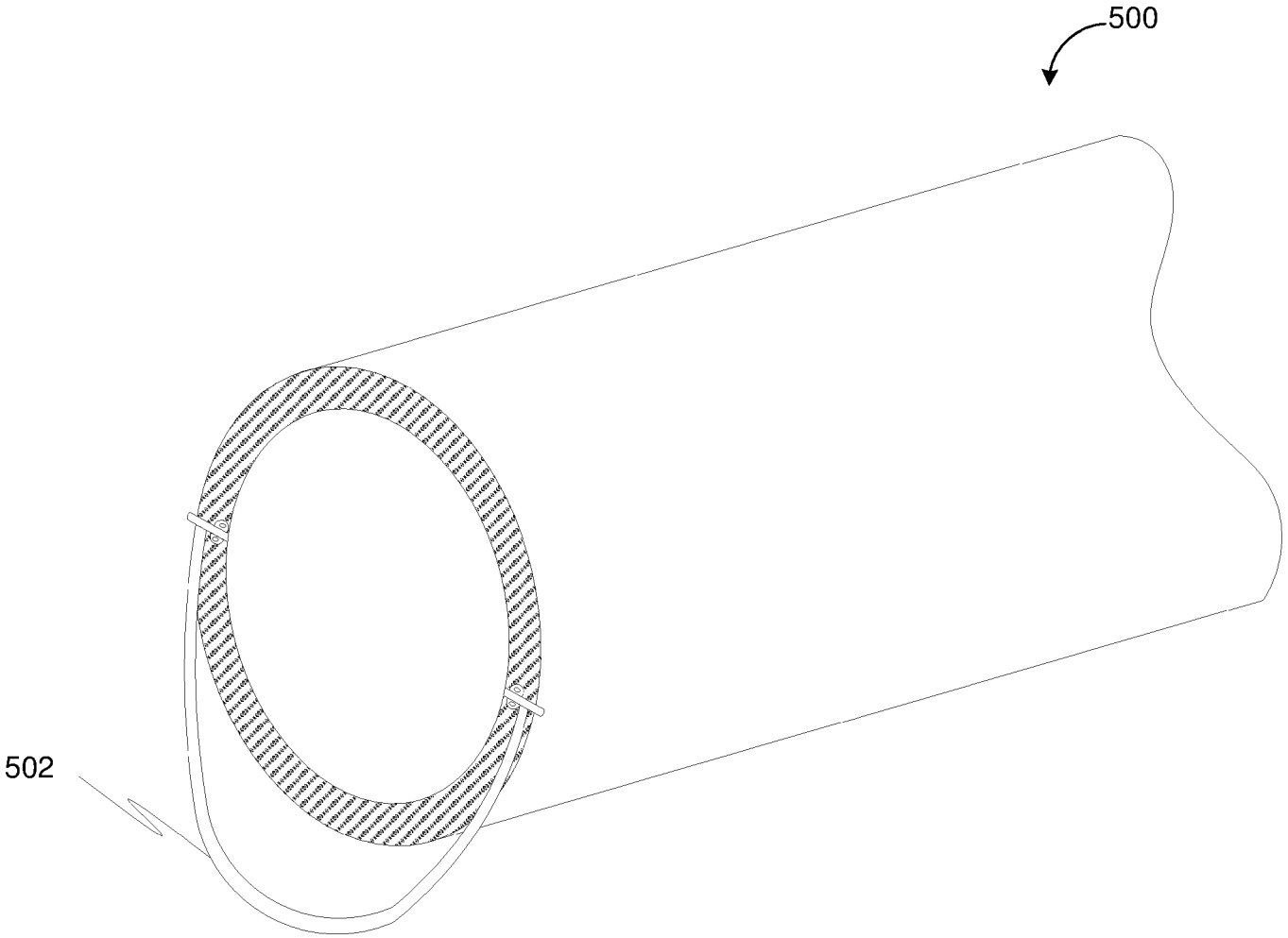
FIG. 5 illustrates a perspective view of a metallic insert including a handle configured to enable a user to perform one or more of insertion and removal of the metallic insert with respect to a furniture.

FIG. 5 illustrates a perspective view of a metallic insert 500 including a handle 502 configured to enable a user to perform one or more of insertion and removal of the metallic insert 500 with respect to a furniture, such as the bed 100 and/or the couch 200. The metallic insert 500 may be an instance of one or more of metallic insert 104, 202 and 300. Accordingly, further details regarding the metallic insert 500 may be obtained from description of FIG. 1 to FIG. 3.

The handle 502 may be attached to an external portion of the metallic insert 500 using hinges. Accordingly, the handle 502 may be configured to move pivotally. Further, in an equilibrium position, the handle 502 may be configured to lie substantially in a plane passing through the opening of the metallic insert 500. Accordingly, the handle 502 may be flush with the opening of the metallic insert 500. As a result, a visual appearance of the furniture may be minimally affected due to presence of the handle 502.

Additionally, when the user wishes to remove the metallic insert 500, the handle 502 may be conveniently gripped with fingers and pulled. Similarly, when the user wishes to insert the metallic insert 500 into the furniture, the handle 502 may be similarly held and pushed to insert the metallic insert 500 into the furniture.

Figure 6:
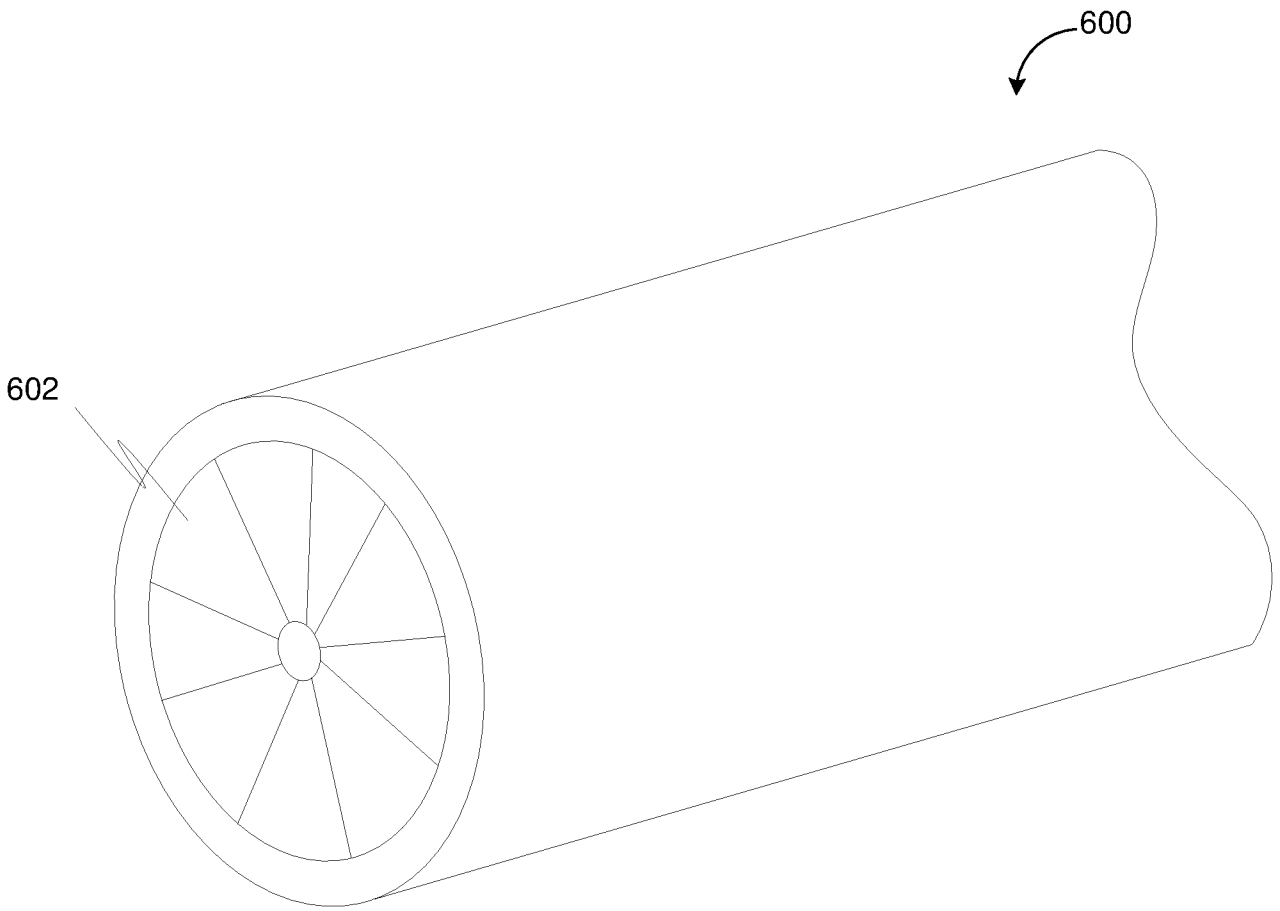
FIG. 6 illustrates a perspective view of a metallic insert including a sphincter configured to enable a user to insert and secure one or more beneficial objects into the metallic insert.

FIG. 6 illustrates a perspective view of a metallic 600 insert including a securing device such as a sphincter 602 configured to enable a user to insert and secure one or more beneficial objects into the metallic insert 600. The sphincter 602 may be constructed from an elastic material, such as, for example, a polymer sheet with embedded elastic strings. Accordingly, in an equilibrium state, the sphincter 602 may be contracted with little or no opening. Other securing devices may include, by way of non-limiting example an end cap, a plug, sealed seam or other mechanical mechanism. As a result, the one or more beneficial objects placed within the metallic insert 600 may be securely held preventing the one or more beneficial objects from falling out through the opening of the metallic insert 600. However, when a user wishes to insert a beneficial object into the hollow space of the metallic insert, the user may place the beneficial object against the surface of the sphincter 602 and exert a forward push. Since the sphincter 602 is elastic in nature, the opening of the sphincter 602 may increase due to the pressure. As a result, the beneficial object may be pushed into the hollow space of the metallic insert 602 and remain secured within the hollow space.

Figure 7:
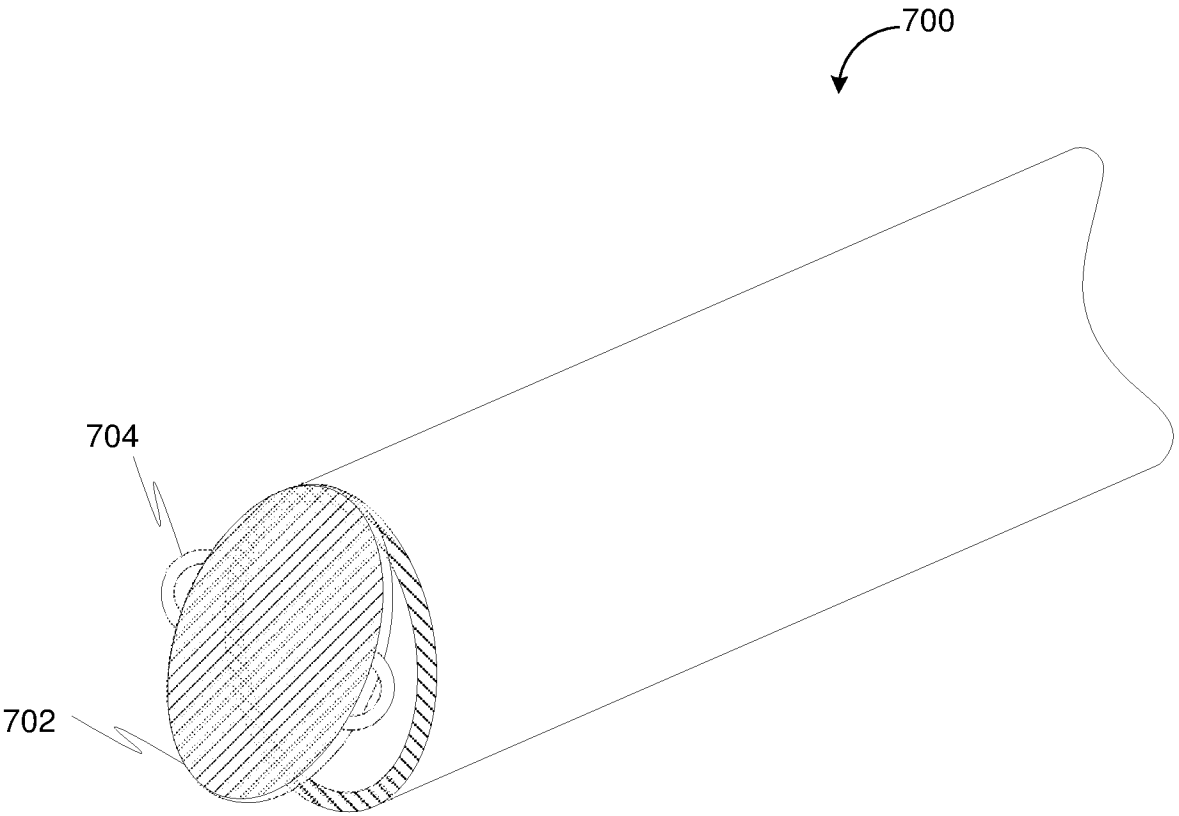
FIG. 7 illustrates a perspective view of a metallic insert including a sliding cover configured to enable a user to insert and secure one or more beneficial objects into the metallic insert.

FIG. 7 illustrates a perspective view of a metallic insert 700 including a sliding cover 702 configured to enable a user to insert and secure one or more beneficial objects into the metallic insert 700. The sliding cover 702 may include one or more handles 704 configured to be held by fingers or by a suitable tool. Further, the sliding cover 702 may be attached to an opening of the metallic insert 700 at a point using a fastener (not shown in figure). The fastener may be configured to allow the sliding cover 702 to move in relation to the opening of the metallic insert 700.

Further, in some embodiments, the sliding cover 702 may be configured to be moved laterally along the plane passing through the opening of the metallic insert 700. In other embodiments, the sliding cover 702 may be configured to move in a direction away from the plane passing through the opening of the metallic insert 700.

Further, in some embodiments, in an equilibrium state, the sliding cover 702 may completely cover the opening of the metallic insert 700. For instance, the fastener may include a means, such as a spring, in order to return the sliding cover 702 to the equilibrium position when no force is being applied. Accordingly, one or more beneficial objects placed within the hollow space of the metallic insert 700 may be securely held.

FIG. 8 illustrates a perspective view of a furniture such as a bed 800 with a base 802 and a mattress 804, including a plurality of metallic inserts 806 arranged in a plurality of layers in accordance with some embodiments.

The plurality of metallic inserts 806 may be arranged in a predetermined spatial configuration. Further, in some embodiments, the plurality of metallic inserts 806 may include a first set of metallic inserts **806*a* and a second set of metallic inserts 806*b*. Additionally, each of the first set of metallic inserts 806*a* may be oriented perpendicular to each of the second set of metallic inserts 806*b*. Furthermore, the first set of metallic inserts 806*a* may be oriented along a North-South direction while the second set of metallic inserts 806*b* may be oriented along an East-West direction. Additionally, in some embodiments, the plurality of metallic inserts 806 may be arranged in a plurality of layers. Each layer may include a plurality of metallic inserts 806** configured to lie in a plane.

Figure 9:
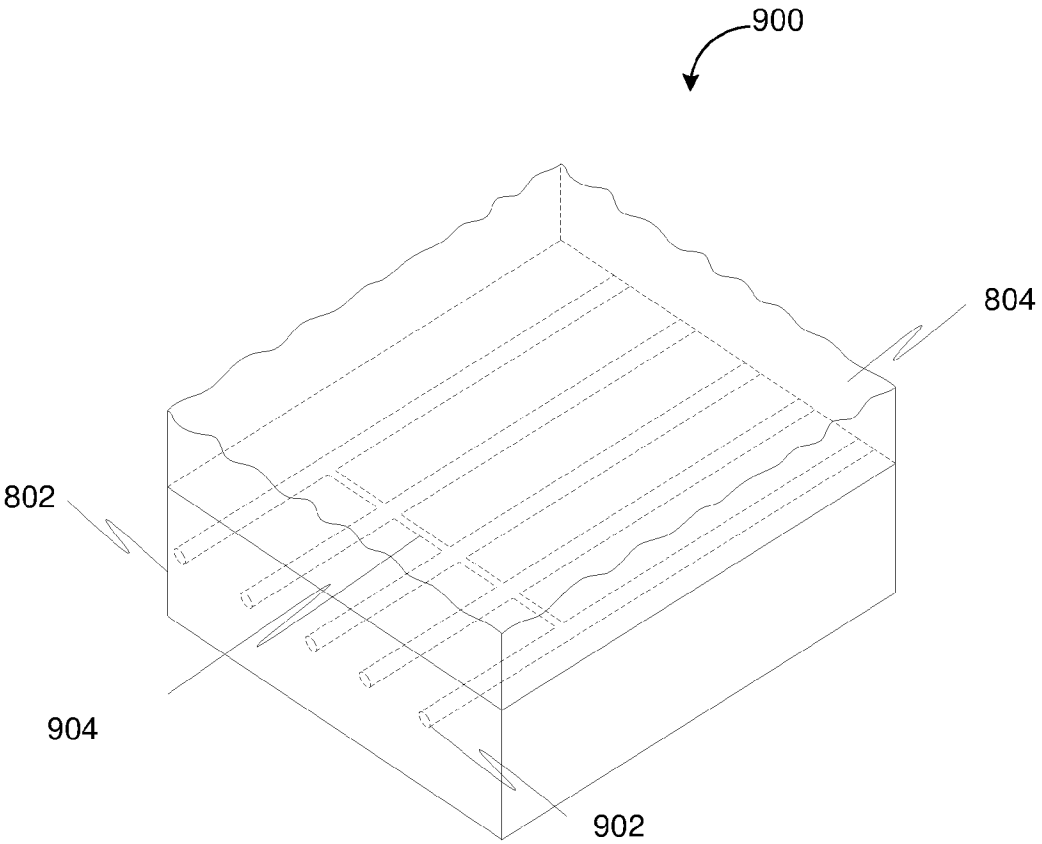
FIG. 9 illustrates a perspective view of a plurality of metallic inserts electrically connected with each other in order to provide charge neutralization on a furniture including the plurality of metallic inserts in accordance with some embodiments.

Turning to FIG. 9, a perspective view of a furniture 900 including a plurality of metallic inserts 902 electrically connected with each other in order to provide charge neutralization on the furniture in accordance with some embodiments is illustrated. Accordingly, a first metallic insert of the plurality of metallic inserts 902 may be electrically connected to a second metallic insert of the plurality of metallic inserts 902. Additionally, in some embodiments, the furniture, such as, bed 900 may further include electrical conductors 904 configured to connect the first metallic insert and the second metallic insert. Further, in some embodiments, the furniture 900 may further include conductive fibres (not shown in figure) configured to connect the first metallic insert and the second metallic insert. Additionally and/or alternatively, in some embodiments, the furniture 900 may include a plurality of springs (not shown in figure) configured to provide each of cushioning and electrical connection between the first metallic insert and the second electrical insert.

Figure 10:
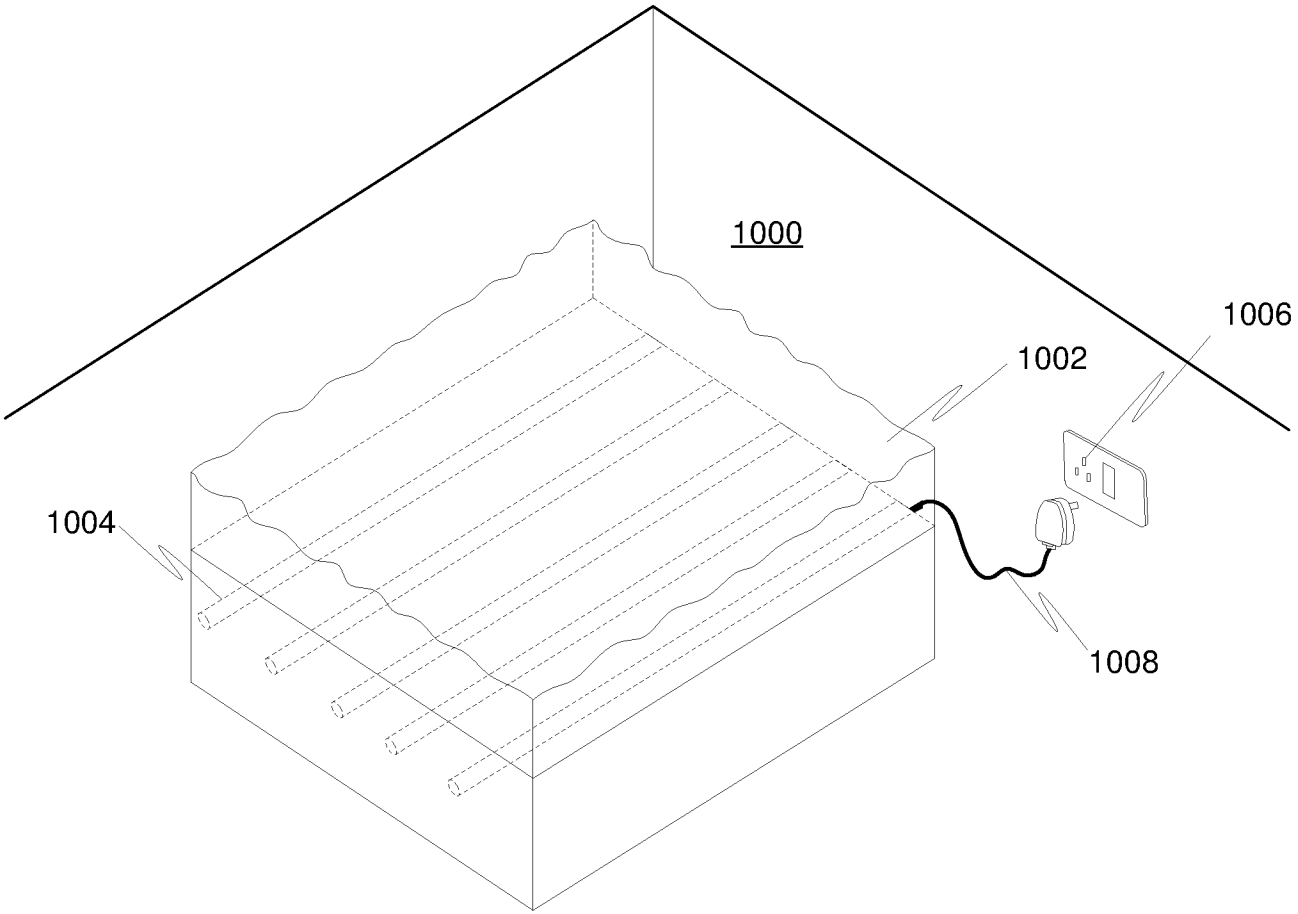
FIG. 10 illustrates a perspective view of a furniture, such as a bed with a mattress, including one or more metallic inserts electrically connected to a ground terminal of a power outlet in accordance with some embodiments.

FIG. 10 illustrates a perspective view of a furniture 1000, such as a bed with a mattress 1002, including one or more metallic inserts 1004 electrically connected to a ground terminal 1006 of a power outlet in accordance with some embodiments. A first end of the ground connector 1008 may be configured to be electrically connected to the one or more metallic inserts 1004. Further, a second end of the ground connector 1008 may be configured to be electrically connected to the ground terminal 1006 of the power outlet.

Accordingly, the one or more metallic inserts 1008 may be configured to neutralize charges generated on a surface of the furniture 1000.

Further, in some embodiments, an electrical path may be established between the one or more metallic inserts 1008 and a portion of the mattress 1002. Consequently, static electric charges accumulated on the mattress 1002 may be neutralized by allowing flow of charges to and/or from the one or more metallic inserts 1008. Furthermore, the electrical connection of the one or more metallic inserts 1008 to the ground terminal 1006 of the power outlet may facilitate neutralization of charges by sourcing and/or sinking electric charges.

It will be appreciated that various above-disclosed embodiments, other features and functions, or alternatives thereof, may be desirably combined into many other different systems or applications. Various presently unforeseen or unanticipated alternatives, modifications, variations, or improvements therein may be subsequently made by those skilled in the art.

What is claimed is:

1. An article of furniture for facilitating well-being of a user of the furniture, the article of furniture comprising: at least one hollow metallic insert configured to accommodate a beneficial object inside the hollow metallic insert, said hollow metallic insert removably fixed within a cavity located in the article of furniture, a shape of the cavity being in spatial conformance with external dimensions of the at least one metallic insert and a surface of the article of furniture; and a securing device for securing the beneficial object within the hollow metallic insert, wherein the at least one hollow metallic insert comprises a plurality of metallic inserts arranged in a predetermined spatial configuration, wherein the plurality of metallic inserts are arranged in a plurality of layers, wherein each layer comprises a plurality of metallic inserts configured to lie in a plane.

2. The article of furniture of claim 1, wherein a first metallic insert of the plurality of metallic inserts is electrically connected to a second metallic insert of the plurality of metallic inserts.

3. The article of furniture of claim 2 further comprising electrical conductors configured to connect the first metallic insert and the second metallic insert.

4. The article of furniture of claim 2 further comprising conductive fibres configured to connect the first metallic insert and the second metallic insert.

5. The article of furniture of claim 3 further comprising a plurality of springs configured to provide each of cushioning and electrical connection between the first metallic insert and the second electrical insert.

6. The article of furniture of claim 1, wherein the part of the furniture configured to receive the at least one metallic insert comprises a base of the furniture and the metallic insert is removable from a cavity in the base of the furniture.

* * * * *